US006441699B2

(12) United States Patent
Yamada et al.

(10) Patent No.: US 6,441,699 B2
(45) Date of Patent: Aug. 27, 2002

(54) DIRECTIONAL COUPLER, ANTENNA DEVICE, AND TRANSMITTING-RECEIVING DEVICE

(75) Inventors: Hideaki Yamada, Ishikawa-ken; Toru Tanizaki, Nagaokakyo; Kazutaka Higashi, Hirakata, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/928,208

(22) Filed: Aug. 10, 2001

Related U.S. Application Data

(62) Division of application No. 09/346,813, filed on Jul. 2, 1999, now Pat. No. 6,285,266.

(30) Foreign Application Priority Data

Jul. 6, 1998 (JP) ..... 10-190697

(51) Int. Cl.[7] ..... H01P 5/18; H01P 5/02

(52) U.S. Cl. ..... 333/111; 333/113; 333/116

(58) Field of Search ..... 333/109, 110, 333/111, 113, 116

(56) References Cited

U.S. PATENT DOCUMENTS 6,147,658 A * 11/2000 Higashi et al. ..... 343/853
6,246,298 B1 * 6/2001 Ishikawa et al. ..... 333/101

* cited by examiner

*Primary Examiner*—Robert Pascal
*Assistant Examiner*—Stephen E. Jones
(74) *Attorney, Agent, or Firm*—Ostrolenk, Faber, Gerb & Soffen, LLP

(57) ABSTRACT

A first transmission line and a second transmission line are caused to be partially opposite to each other, and by use of the opposite portions of the first transmission line and the second transmission line, the first transmission line and the second transmission line are relatively shifted in parallel from their opposite state to their non-opposite state.

3 Claims, 4 Drawing Sheets

DIRECTIONAL COUPLER, ANTENNA DEVICE, AND TRANSMITTING-RECEIVING DEVICE

CROSS REFERENCE TO RELATED APPLICATION

This is a divisional of U.S. patent application Ser. No. 09/346,813, filed Jul. 2, 1999 in the name of Hideaki YAMADA et al., now U.S. Pat. No. 6,285,266, and entitled "DIRECTIONAL COUPLER, ANTENNA DEVICE, AND TRANSMITTING-RECEIVING DEVICE."

BACKGROUND OF THE INVENTION

1. Field of the Invention

The present invention relates to a directional coupler, an antenna device, and a transmitting-receiving device which are useful for a radar or the like with which the distance to and the relative velocity of a detection object are measured by transmission-reception of an electromagnetic wave, for example, in the millimeter wave band.

2. Description of the Related Art

In recent years, a so called "millimeter wave radar for car-mounting" has been developed, of which the purpose lies in that the distance to and the relative velocity of a vehicle running ahead or behind are measured in a vehicle running on a road and so forth. In general, the transmitting-receiving device of the millimeter wave radar of the above type includes a module comprising a millimeter wave oscillator, a circulator, a directional coupler, a mixer, an antenna, and so forth which are integrated together, and is attached to the front or rear of the vehicle.

For example, with the module of this type, the relative distance and the relative velocity of a vehicle running ahead are measured at a vehicle running behind, by transmission-reception of a millimeter wave according to the FM-CW system or the like. The transmitting-receiving device and the antenna of the module are attached to the front of the vehicle, and a signal processing device is disposed in an optional location of the vehicle. In the signal processing section of the signal processing device, the distance to and the relative velocity of the vehicle running ahead are extracted as numerical information. In the control-alarm section, based on the velocity of the vehicle running behind and the distance between the vehicles, an alarm is given, for example, when predetermined conditions are satisfied, or when the relative velocity for the vehicle running ahead exceeds a predetermined threshold.

In the millimetric radar of the above type, the directivity of the antenna is fixed. Therefore, there may occur the case that the desired detection or measurement can not be performed depending on conditions, as described below. More particularly, for example, if vehicles run in plural traffic lanes, it can not be determined immediately whether a vehicle running ahead is present in the same lane where the vehicle is running behind, only by receiving an electromagnetic wave reflected from the vehicle running ahead. More particularly, when an electromagnetic wave is sent as a radiation beam from the vehicle running behind, a reflected wave from the vehicle running ahead, and moreover, a reflected wave from a vehicle running in the opposite lane may be received. The relative velocity determined based on the reflected wave from the vehicle running in the opposite lane is unduly high. As a result, inconveniently, an error alarm is given. Further, if vehicles are running on a curved road, a vehicle running ahead is out of the detection range of the radiation beam and can not be detected, by sending forward an electromagnetic wave as a radiation beam from the vehicle running behind, Further, if vehicles are running on a hilly road, a vehicle running ahead in the lane where the vehicle is running behind is out of the detection range of the radiation beam, and can not be detected.

Accordingly, it is speculated that the above-described problems can be dissipated by varying the direction of the radiation beam.

For example, in the case that vehicles run in several traffic lanes, two detection objects adjacent to each other in the forward angular directions can be separately detected by changing the radiation beam, operational processing, and comparing the measurement results in the respective beam directions. If the vehicles are running on a curved road, the curve of the road is decided based on the steering operation (steering by a steering wheel) or by analyzing the image information obtained with a camera photographing the forward view, and the radiation beam is directed to the direction in dependence on the decision, so that the vehicle running ahead can be detected. Further, if the vehicle is running on a hilly road, the undulation of the road is decided by analysis of image information obtained with a camera photographing the forward view. The radiation beam is directed upwardly in dependence on the decision, so that the vehicle running ahead can be detected.

However, referring to the method of changing the directivity of an electromagnetic wave in the conventional transmitting-receiving device operative in the microwave band or millimeter wave band, the whole of a casing containing the transmitting-receiving device including the antenna is rotated only with a motor or the like to change (tilt) the direction of the radiation beam. Accordingly, the whole of the device is large in size, and it is difficult to scan with the radiation beam with the direction of the radiation beam changed at a high speed.

Conventionally, by another method, beam-scan antennas for switching plural antennas to scan with a beam are employed. However, by the beam scan antenna method, it is necessary to provide as many antennas as beams. Accordingly, if the beam scan antenna is used in the transmitting-receiving device, there is caused the problem that the whole size of the device is large. Further, since as many antennas as beams are used, it is needed to arrange the respective antennas in consideration of their scan ranges. Thus, the arrangement of the antennas is difficult. Further, in order to switch the plural antennas for inputting or outputting, electronic switches such as diodes or the like are used. The loss at the switching is too large to be neglected in the millimeter wave band. Further, it is needed to switch on-off the beams from the plural antennas, and therefore, it is necessary to provide as many electronic switches as antennas. The electronic switch such as a diode or the like is expensive. Thus, there is the problem that the beam scan antenna using many electronic switches costs a great deal.

In recent years, investigation on three dimensional beam scanning by which upper, lower, right, and left sections are scanned has been made. If a method of moving the whole casing of the transmitting-receiving device only by means of a motor or the like is employed, there is caused the problem that the whole structure is further enlarged, and the scanning at high speed is difficult.

Further, for three dimensional beam scanning by means of a multi-beam antenna, it is needed to arrange antennas in the upper, lower, right, and left sections. Thus, there is caused the problem that the whole structure is large in size, and the connection, switching, and arrangement of the respective antennas is very difficult.

SUMMARY OF THE INVENTION

Accordingly, it is an object of the present invention to solve the above problems and to provide a directional coupler with which switching on-off can be performed by changing the relative positions of two transmission lines, an antenna device, and a transmitting-receiving device which can be easily miniaturized and of which the directivity can be switched at a high speed, respectively, due to the directional coupler.

According to a first aspect of the present invention, there is provided a directional coupler including a first transmission line and a second transmission line which are partially opposite to each other, the opposite portions of the first transmission line and the second transmission line being relatively shiftable in parallel and operative to be shifted from their opposite state to their non-opposite state.

With the above structure, the coupling portion of the directional coupler can be used as a switch.

In the directional coupler in accordance with the present invention, either of the first transmission line and the second transmission line may comprise plural transmission lines.

Accordingly, the plural transmission lines can be switched.

According to a second aspect of the present invention, there is provided a directional coupler including a first transmission line and a second transmission line which are partially opposite to each other, the opposite portions of the first transmission line and the second transmission line being relatively shiftable in parallel, the first transmission line being capable of being connected by the parallel shift of the first transmission line, to plural third transmission lines individually which are on the opposite side to the opposite portions of the first transmission line and the second transmission line.

With the above structure, the plural lines can be switched.

Preferably, there is provided an antenna device including the directional coupler in accordance with the present invention, a primary radiator connected to the first transmission line, and a terminal resistor connected to one end of the second transmission line.

With the above structure, the transmission and reception through the antenna can be switched.

Also preferably, there is provided an antenna device containing the directional coupler in accordance with the present invention, plural primary radiators connected to the first transmission line and a terminal resistor connected to one end of the second transmission line.

With the above structure, beam scanning with plural beams is enabled.

Preferably, in the antenna device, the first transmission line consists of plural transmission lines, a primary radiator is connected to at least one of the plural first transmission lines, one of the plural first transmission lines, not connected to the primary radiator, functions as a measurement terminal.

With the above structure, the output characteristics of the antenna in the coupling state caused by the directional coupler can be measured.

Preferably, in the antenna device, the terminal resistor is removable, and one end of the second transmission line having the terminal resistor connected thereto is used as a measurement terminal.

With the above structure, the characteristics of the antenna device prior to the coupling by use of the directional coupler can be measured.

Preferably, there is provided a transmitting-receiving device including the antenna device in accordance with the present invention.

BRIEF DESCRIPTION OF THE DRAWINGS

FIG. 2, comprising

DESCRIPTION OF THE PREFERRED EMBODIMENT

Figure 1:
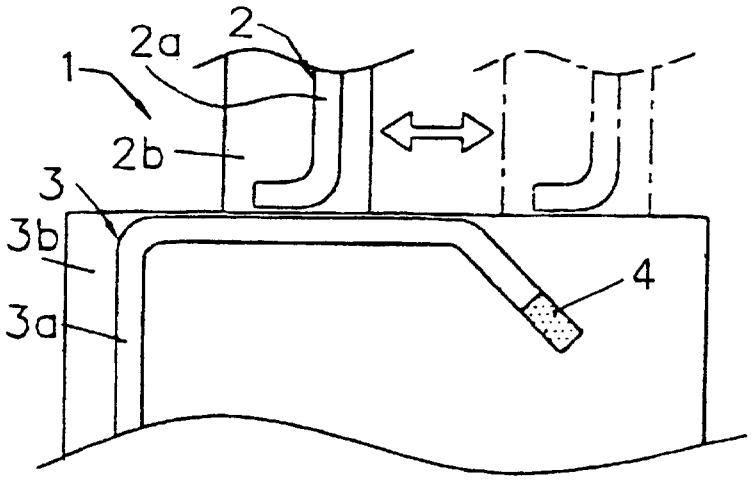
FIG. 1 is a plan view of a directional coupler according to a first embodiment of the present invention.

A first embodiment of the present invention will be now described with reference to FIG. 1. FIG. 1 is a plan view of a directional coupler according to a first embodiment of the present invention.

As shown in FIG. 1, a directional coupler 1 contains a first transmission line 2 and a second transmission line 3 which are partially opposite to each other, and a terminal resistor 4 connected to one end of the second transmission line 3.

The first transmission line 2 is a non-radiative dielectric line, and is formed by sandwiching a dielectric strip 2*a* between an upper metal sheet not shown in FIG. 1 and a lower metal sheet 2*b*. The second transmission line 3 is a non-radiative dielectric line as well as the first transmission line 2, and is formed by sandwiching a dielectric strip 3*a* between an upper metal sheet not shown in FIG. 1 and a lower metal sheet 3*b*.

The upper metal sheet and the lower metal sheet 2*b* of the first transmission line 2 are independent from the upper metal sheet and the lower metal sheet 3*b* of the second transmission line 3, and can be shifted in parallel to each other as shown by the arrow of FIG. 1. With this structure, the first transmission line 2 is shifted in parallel to the second transmission line 3 while being kept in the opposite state to the position indicated by the alternate long and short dash line in FIG. 1, and thereby, the first transmission line 2 moves to non-opposite state to the second transmission line 3.

As seen in the above description, in the directional coupler 1, the first transmission line 2 and the second transmission line 3 are electro-magnetically coupled with each other when the first transmission line 2 and the second transmission line 3 are in the opposite state, and thereby, a signal input to the first transmission line 2 is sent to the second transmission line 3, or a signal input to the second transmission line 3 is sent to the first transmission line 2.

In the directional coupler 1, no electro-magnetic coupling is produced between the first transmission line 2 and the second transmission line 3 when the first transmission line 2 and the second transmission line 3 are in the non-opposite state, and thereby, the signal input to the first transmission line 2 or the signal input to the second transmission line 3 is cut off.

As seen in the above description, in the instant embodiment, the coupling portion of the directional coupler is shifted in parallel from the opposite state to the non-opposite state, that is, the directional coupler can be rendered a switching function.

In the instant embodiment, the first transmission line is shifted. However, this is not restrictive. The second transmission line may be shifted.

Hereinafter, a second embodiment of the present invention will be described. FIG. 2 is a plan view of a directional coupler according to the second embodiment of the present invention.

As shown in FIG. 2, the directional coupler 11 has the structure that one of the first transmission lines 12, 13, and 14 and a second transmission line 15 are partially opposite to each other, and a terminal resistor 16 is connected to one end of the second transmission line 15.

The first transmission lines 12, 13, and 14 are non-radiative dielectric lines, and are formed by sandwiching dielectric strips 12*a*, 13*a*, and 14*a* between an upper metal sheet not shown in FIG. 2 and a lower metal sheet 12*b*, respectively. The second transmission line 15 is a non-radiative dielectric line as well as the first transmission lines 12, 13, and 14, and is formed by sandwiching a dielectric strip 13*a* between an upper metal sheet not shown in FIG. 2, and a lower metal sheet 13*b*.

Figure 2A:
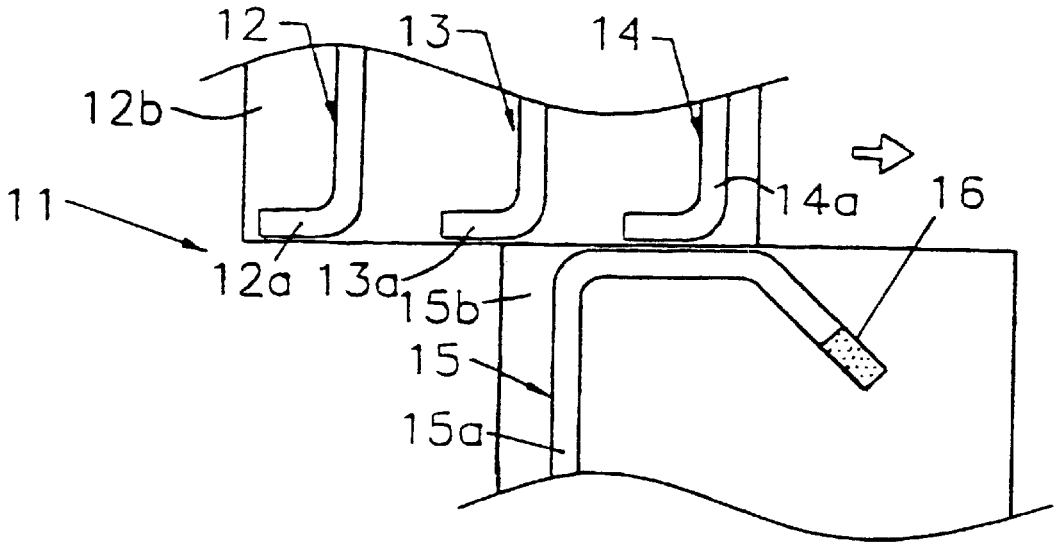
FIGS. 2A and 2B, is a plan view of a directional coupler according to a second embodiment of the present invention.

The upper metal sheet and the lower metal sheet 12*b* of the first transmission lines 12, 13, and 14 are independent from the upper metal sheet and the lower metal sheet 15*b* of the second transmission line 15, and can be shifted in parallel as shown by the arrow of FIG. 2A. With this structure, the first transmission line 14 is shifted in parallel to move into the non-opposite state to the second transmission line 15. The first transmission line 14, after it is in the non-opposite state to the second transmission line 15, moves into the opposite state to the second transmission line 15. Further, the first transmission lines 14, 13, and 12 are shifted in parallel in the direction indicated by the arrow of FIG. 2A, so that the first transmission line 13 is in the non-opposite state to the second transmission line 15, and thereafter, the first transmission line 12 moves into the non-opposite state to the second transmission line 15.

Figure 2B:
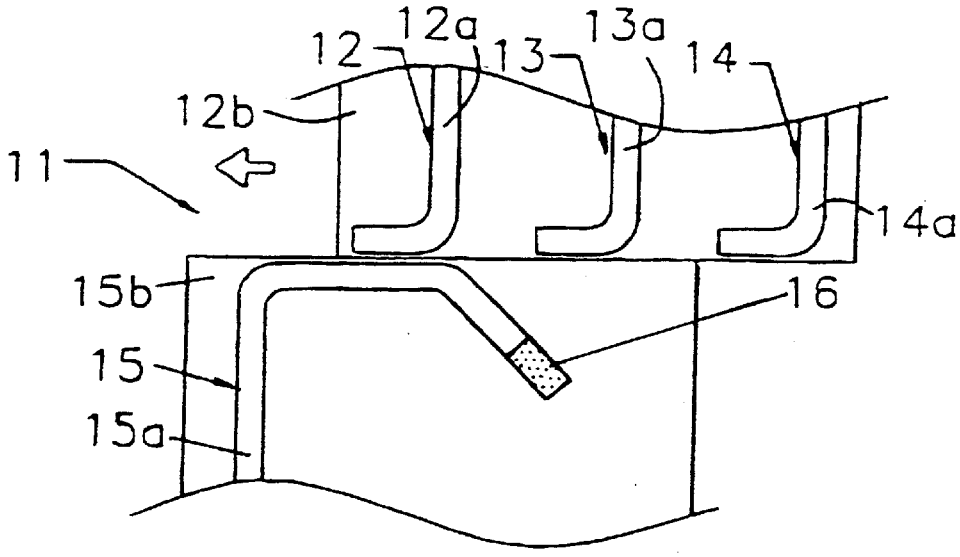

The first transmission line 12, from the position where the first transmission line 12 is in the opposite state to the second transmission line 15, is further shifted in parallel in the direction shown by the arrow of FIG. 2B. The states illustrated in FIG. 2A and FIG. 2B are repeated alternately, so that any one of the first transmission lines 12, 13, and 14 move into the opposite state of the second transmission line 15, or all of the first transmission lines 12, 13, and 14 move into the non-opposite state for the second transmission line 15.

As described above, in the directional coupler 11, one of the plural first transmission lines 12, 13, and 14 which is in the opposite state to the second transmission line 15 is electro-magnetically coupled with the second transmission line 15, and thereby, a signal input to the first transmission line which is in the opposite state is sent to the second transmission line 15. Alternately, a signal input to the second transmission line 15 is sent to the first transmission line which is in the opposite state.

Further, in the directional coupler 11, of the first transmission lines 12, 13, and 14, the transmission lines excluding one which is in the opposite state are in the non-opposite state for the second transmission line. Therefore, no electromagnetic coupling is produced between the first transmission lines and the second transmission line 15 which are in the non-opposite state to each other, so that a signal input through the first transmission lines which are in the non-opposite state is cut off, or a signal input through the second transmission line 15 is not sent to the transmission lines which are in the non-opposite state.

As described above, in the instant embodiment, one of the first and second transmission lines comprises plural transmission lines, and the coupling portion is shifted in parallel, so that one of the plural transmission lines moves into the opposite state and the others move into the non-opposite state. Thus, the directional coupler can be rendered a switching function.

Further, in the instant embodiment shown in FIGS. 2A and 2B, by reducing the intervals between the first transmission lines 12, 13, and 14, and also shortening the portion of the second transmission line 15 which is parallel to the first transmission lines, the respective coupling portions are reduced. Therefore, the switching of the first transmission lines 12, 13, and 14 to be coupled with the second transmission line 15 can be quickly performed by a smaller, shifting amount, i.e., the miniaturization of the device can be realized.

On the other hand, by widening the intervals between the first transmission lines 12, 13, and 14 and lengthening the portion of the second transmission line 15 parallel to the first transmission lines, the coupling portion is lengthened, and thereby, the connection time of the respective first transmission lines 12, 13, and 14 coupled with the second transmission line 15 can be increased.

Also in the instant embodiment, the first transmission line is shifted. However, the shifting is not limited to the shift of the first transmission lines. The second transmission line may be shifted. Further, in the instant embodiment, the second transmission line comprises plural first transmission lines. However, the configuration of the plural first transmission lines is not limited to the second transmission line. The second transmission line or both of the first and second transmission lines may comprises plural transmission lines, respectively.

Figure 3:
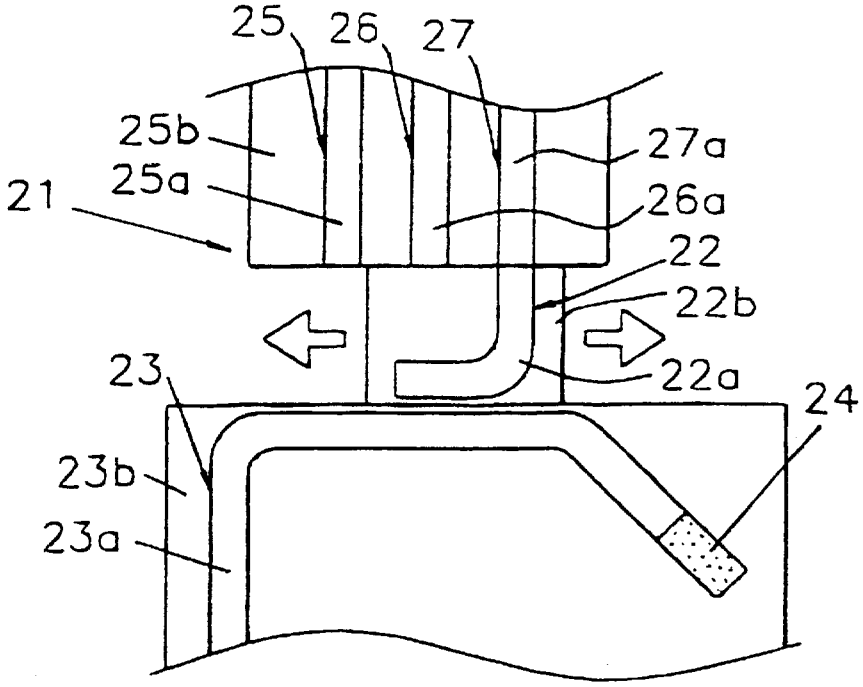
FIG. 3 is a plan view of a directional coupler according to a third embodiment of the present invention.

Hereinafter, a third embodiment of the present invention will be described. FIG. 3 is a plan view of a directional coupler according to the third embodiment of the present invention.

As seen in FIG. 3, a directional coupler 21 contains a first transmission line 22 and a second transmission line 23 which are partially opposite to each other, and a terminal resistor 24 connected to one end of the second transmission line 23. Further, the directional coupler 21 is so configured that the first transmission line 22 can move into a position opposite to the end-face of any one of the third transmission lines 25, 26, and 27, on the opposite side to the opposite portion of the first transmission line 22 and the second transmission line 23, or does not become opposite to any one of the third transmission lines 25, 26, and 27.

The first transmission line 22 is a non-radiative dielectric line, and is formed by sandwiching a dielectric strip 22*a* between an upper metal sheet not shown in FIG. 3 and a lower metal sheet 22*b*. The second transmission line 23 is a non-radiative dielectric line as well as the first transmission line 22, and is formed by sandwiching a dielectric strip 23*a* between an upper metal sheet not shown in FIG. 3 and an lower metal sheet 23*b*. The third transmission lines 25, 26, and 27 are non-radiative dielectric lines as well as the first transmission line 22 and the second transmission line 23, and is formed by sandwiching dielectric strips 25*a*, 26*a*, and 27*a* between an upper metal sheet not shown in FIG. 3 and a lower metal sheet 25*b*.

The upper metal sheet and the lower metal sheet 22*b* of the first transmission line 22 are independent from the upper metal sheet and the lower metal sheet 23*b* of the second transmission line 23, and the upper metal sheet and the lower metal sheet 25*b* of the third transmission lines 25, 26, and 27, and can be shifted in parallel as shown by the arrow of FIG. 3. With this structure, the first transmission line 22 can be shifted in parallel to move into the connection state for the transmission lines 25, 26, and 27, individually.

As described above, in a directional coupler 21, the first transmission line 22 is electro-magnetically coupled with the second transmission line 23 at all times, and thereby, a signal input through any one of the third transmission lines 25, 26, and 27 is input to the first transmission line and then sent to the second transmission line 23, or a signal input through the second transmission line 23 is input to the first transmission line, and sent to one of the third transmission lines 25, 26, and 27.

As described above, in the directional coupler of the instant embodiment, as the third transmission line, plural transmission lines are formed, and the coupling portion of the first transmission line and the second transmission line is shifted in parallel, so that the transmission line in the connection state and the transmission lines in the non-connection state of the third transmission lines are present. Thus, the directional coupler can be rendered a switching function.

In the instant embodiment of FIG. 3, only the first transmission line is shifted in parallel, and thereby, the switching of the third transmission lines 25, 26, and 27 can be quickly performed by a relatively small shifting amount, and the device can be miniaturized.

Figure 4:
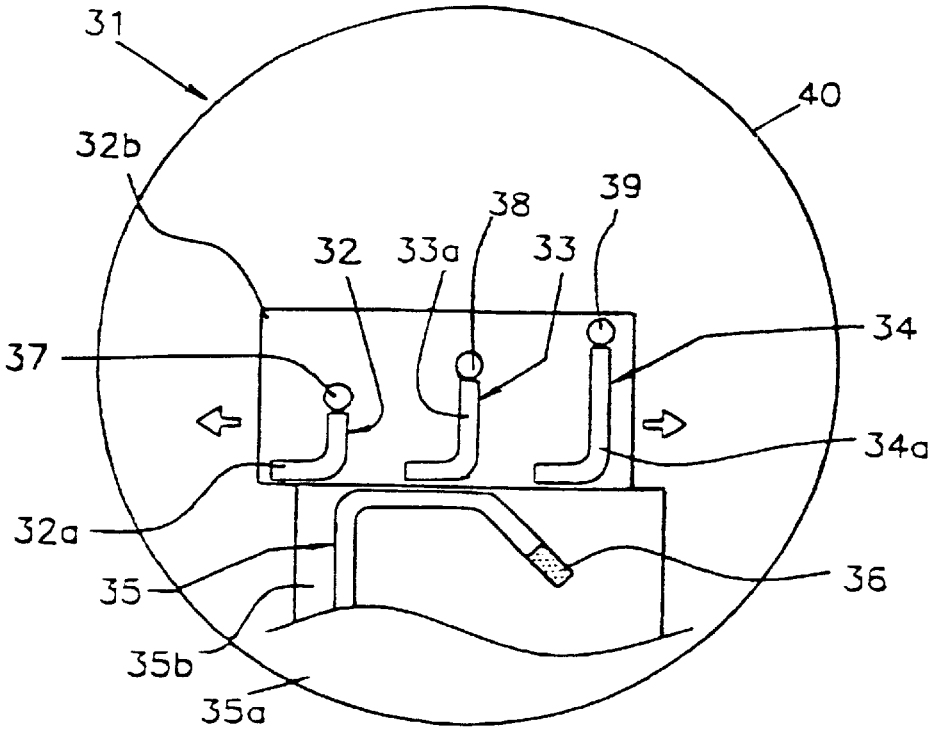
FIG. 4 is a plan view of an antenna device according to a fourth embodiment of the present invention.

Hereinafter, a fourth embodiment of the present invention will be described. FIG. 4 is a plan view of an antenna device according to a fourth embodiment of the present invention.

As shown in FIG. 4, an antenna device 31 has the structure that one of the first transmission lines 32, 33, and 34 is in a partially opposite state to the second transmission line 35, a terminal resistor is connected to one end of the second transmission line 35, and primary radiators 37, 38, and 39 are coupled with the first transmission lines 32, 33, and 34, respectively. A lens antenna illustrated by the reference numeral 40 is fixed to a casing not shown in FIG. 4, and has the function of radiating an electromagnetic wave through the primary radiators coupled with the first transmission lines 32, 33, and 34 and converging an electromagnetic wave transmitted from the outside.

The first transmission lines 32, 33, and 34 are non-radiative dielectric lines, and are formed by sandwiching dielectric strips 32*a*, 33*a*, and 34*a* between an upper metal sheet not shown in FIG. 4 and a lower metal sheet 32*b*. The second transmission line 35 is a non-radiative dielectric line as well as the first transmission lines 32, 33, and 34, and is formed by sandwiching a dielectric strip 35*a* between an upper metal not shown in FIG. 4 and a lower metal sheet 35*b*.

The upper metal sheet and the lower metal sheet 32*b* of the first transmission lines 32, 33, and 34 are independent from the upper metal sheet and the lower metal sheet 35*b* of the second transmission line 35, and can be shifted in parallel as shown by the arrow of FIG. 4.

With this structure, the first transmission line 32 is shifted in parallel to move into the non-opposite state to the second transmission line 35. After the first transmission line 32 moves into the non-opposite state to the second transmission line 35, the first transmission line 33 moves into the opposite state to the second transmission line 35. Further, the first transmission lines 32, 33, and 34 are shifted in parallel, so that the first transmission line 33 moves into the non-opposite state to the second transmission line 35, and thereafter, the first transmission line 34 moves into the opposite state to the second transmission line 35. Thus, any one of the first transmission lines 32, 33, and 34 moves into the opposite state to the second transmission line 35, or no one of the first transmission lines 32, 33, and 34 moves into the opposite state to the second transmission line 35.

Primary radiators 37, 38, and 39 are coupled with the ends of the first transmission lines 32, 33, and 34 on the side thereof opposite to the second transmission line, respectively. The primary radiators 37, 38, and 39, which are mounted onto the lower metal sheet 32*b* of the first transmission lines 32, 33, and 34, are shifted in parallel, simultaneously with the first transmission lines.

The positions of the primary radiators 37, 38, and 39 with respect to the lens antenna 40 are changed by the parallel shifting of the primary radiators 37, 38, and 39, so that beams radiated from the lens antenna 40 scan in parallel. In addition, as shown in FIG. 4, the positions of the primary radiators 37, 38, and 39 with respect to the lens antenna are shifted from each other. Therefore, scanning can be made in three steps in the vertical direction. For example, the primary radiator 37 scans the upper section, the primary radiator 38 the central section, and the primary radiator 39 the lower section. Further, since the primary radiators 37, 38, and 39 are shifted in parallel, scanning in the right and left direction can be conducted for each of the tree steps in the vertical direction.

As described above, in the instant embodiment, the directional coupler of the second embodiment is employed, and the different primary radiators are coupled with the plural first transmission lines at their different positions, respectively. Therefore, the three dimensional beam scanning can be performed with a less number of primary radiators as compared with conventional three dimensional beam scanning, and moreover, the overall structure of the antenna device can be miniaturized. Further, the connection, switching, and arrangement of the respective antennas can be conveniently performed.

Figure 5:
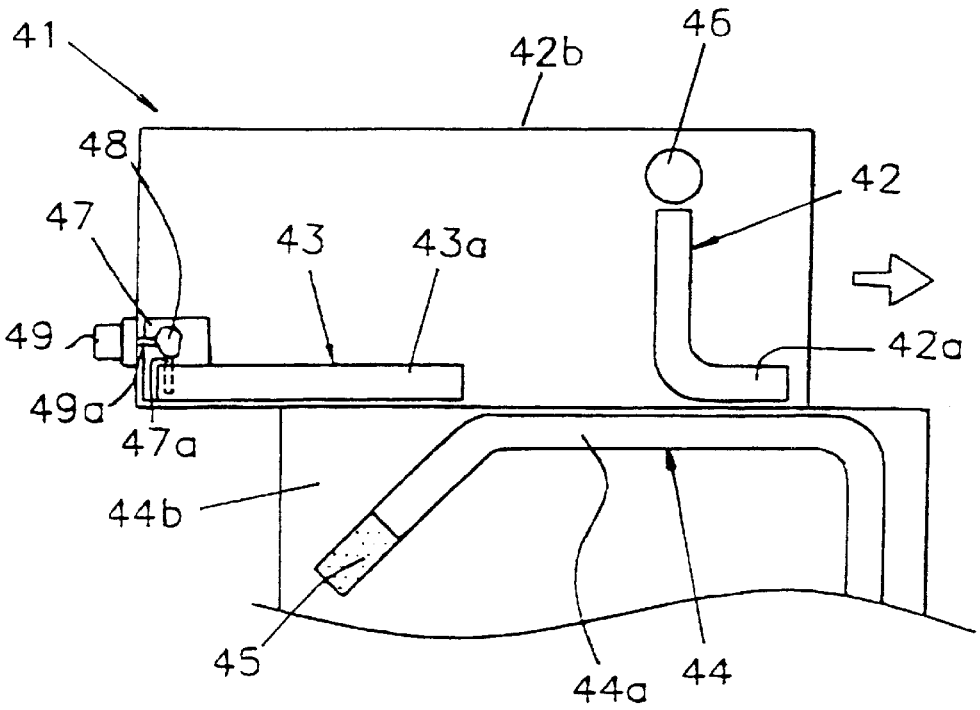
FIG. 5 is a plan view of an antenna device according to a fifth embodiment of the present invention.

Hereinafter, a fifth embodiment of the present invention will be described. FIG. 5 is a plan view of an antenna device according to the fifth embodiment of the present invention.

As shown in FIG. 5, an antenna device 41 has the structure that one of first transmission lines 42 and 43 is partially opposite to the second transmission line 44, a terminal resistor 45 is connected to one end of second transmission line 44, and a primary radiator 46 is coupled with the first transmission line 42.

The first transmission lines 42 and 43 are non-radiative lines, and are formed by sandwiching dielectric strips 42*a* and 43*a* between an upper metal sheet not shown in FIG. 5 and a lower metal sheet 42*b*, respectively. The second transmission line 44 is a non-radiative line as well as the first transmission lines 42 and 43, and is formed by sandwiching a dielectric strip 44*a* between an upper metal sheet not shown in FIG. 5 and a lower metal sheet 44*b*.

Further, the upper metal sheet and the lower metal sheet 42*b* of the first transmission lines 42 and 43 are independent from the upper metal sheet and the lower metal sheet 44*b* of the second transmission line 44, and can be shifted in parallel as shown by the arrow of FIG. 5.

The first transmission line 42 is coupled with the primary radiator 46 on the side of the first transmission line 42 opposite to the second transmission line 44. Ordinarily, the first transmission line 42 is opposite to the second transmission line 44, and thereby, an electromagnetic wave is sent or received through the primary radiator 46. At evaluation by the antenna device 41, the first transmission lines 42 and 43 are shifted in parallel, so that the first transmission line 42 moves into the non-opposite state to the second transmission line 44, and the first transmission line 43 moves into the opposite state to the second transmission line 44. A printed board 47 is sandwiched by use of a dielectric strip 43*a* on the side opposite to the opposite portions of the first transmission line 43 and the second transmission line 44, and thereby, the first transmission line 43 is connected to a strip line 47*a* on the printed board 47. The strip line 47*a* is connected to the core conductor 49*a* of a coaxial connector 49 through solder 48. With the above structure, when the first transmission line 42 is caused to move into the non-opposite state to the second transmission line 44, and the first transmission line 43 is made to move into the opposite state to the second transmission line 44, the measurement-evaluation can be performed through the coaxial connector 49.

In the instant embodiment, as the measurement section, the coaxial connector is utilized. However, the measurement section is not limited to the coaxial connector. For example, a wave guide or a strip line may be utilized as the measurement section. Further, the non-radiative dielectric line itself may be used.

Figure 6:
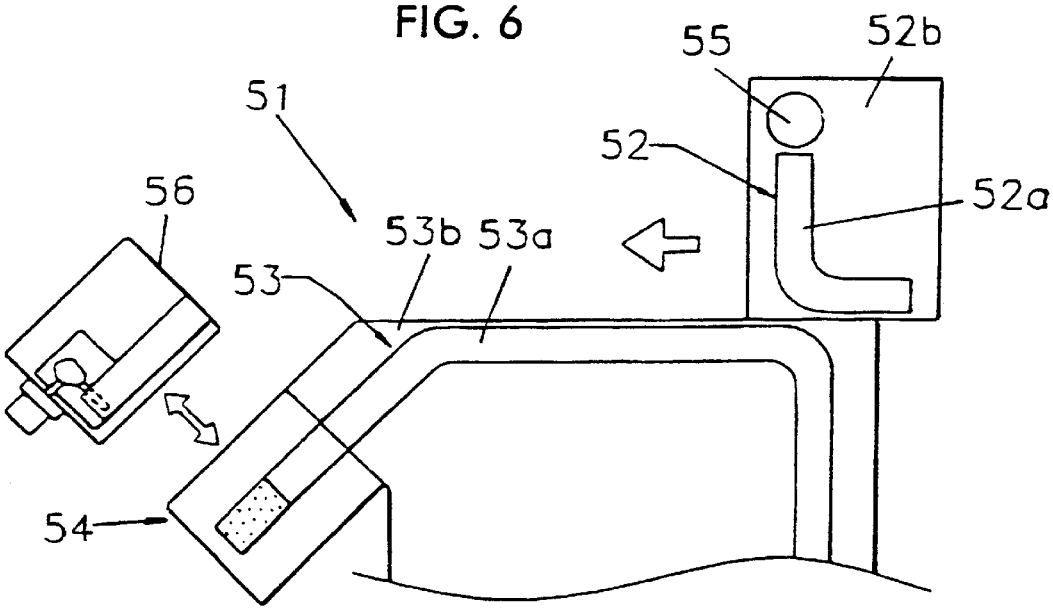
FIG. 6 is a plan view of an antenna device according to a sixth embodiment of the present invention.

Hereinafter, a sixth embodiment of the present invention will be described. FIG. 6 is a plan view of an antenna device according to the sixth embodiment of the present invention.

As shown in FIG. 6, an antenna device 51 has the structure that a first transmission line 52 and a second transmission line 53 are made to move partially into the opposite state to each other, a terminal resistor 54 is connected to one end of the second transmission line 53, and a primary radiator 55 is coupled with the first transmission line 52.

The first transmission line 52 is a non-radiative dielectric line, and is formed by sandwiching a dielectric strip line 52*a* between an upper metal sheet not shown in FIG. 6 and a lower metal sheet 52*b*. Further, the second transmission line 53 is a non-radiative dielectric line as well as the first transmission line 52, and is formed by sandwiching a dielectric strip 53*a* between an upper metal sheet not shown in FIG. 6 and a lower metal sheet 53*b*.

The upper metal sheet and the lower metal sheet 52*b* of the first transmission line 52 are independent from the upper metal sheet and the lower metal sheet 53*b* of the second transmission line 53, and can be shifted in parallel as shown by the arrow of FIG. 6.

The first transmission line 52 is coupled with a primary radiator 55 on the side opposite to the opposite portions of the first transmission line 52 and the second transmission line 53. Ordinarily, the first transmission line 52 is opposite to the second transmission line 53, and thereby, an electromagnetic wave is sent or received through the primary radiator 55. For evaluation by the antenna device 51, the first transmission line 52 is shifted in parallel, and thereby, the first transmission line 52 is shifted in parallel to move into the non-opposite state to the second transmission line 44. The terminal resistor 54 connected to the second transmission line 53 is removable. As shown in FIG. 6, the terminal resistor 54 is replaced by a coaxial converter 56, and thereby, the measurement-evaluation can be carried out through the coaxial converter 56. Further, in the above-described fifth embodiment, the characteristics of the antenna device after coupling through the directional coupler are evaluated. However, in the instant embodiment, the characteristics of the antenna device before coupling through the directional coupler can be evaluated.

In the instant embodiment, a coaxial converter is employed. However, this is not restrictive, and for example, a wave guide converter or a strip line converter may be employed. Further, the measurement may be carried out by means of the non-radiative dielectric line itself, not replaced.

Heretofore, in the antenna devices of the first through third embodiments and the fourth and fifth embodiments, as the first through third transmission lines, non-radiative lines are employed. However, this is not restrictive, and a strip line, a waveguide and the like may be used. Preferably, non-radiative dielectric lines are used from the standpoint of their low loss.

In the directional couplers of the first through third embodiments and the antenna devices of the fourth and fifth embodiments, a means for shifting the first transmission line in parallel are not illustrated. For example, a driving apparatus such as a motor or the like may be employed.

Figure 7:
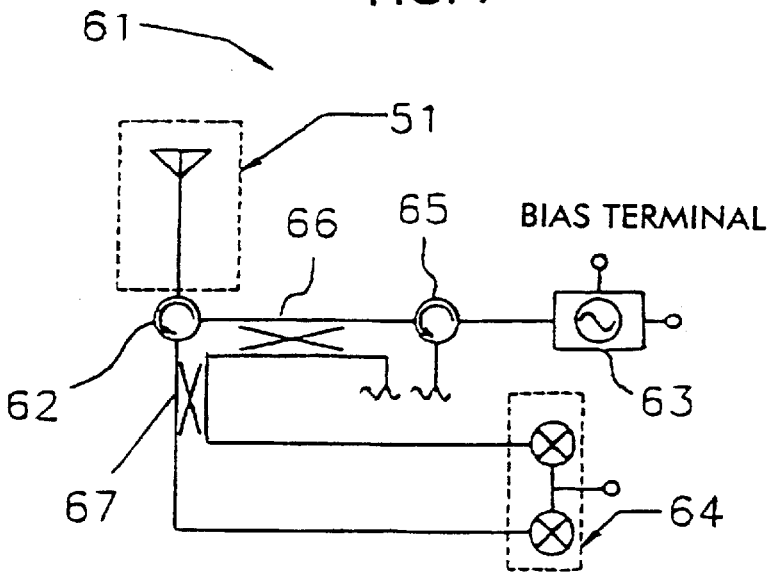
FIG. 7 is a circuit diagram of a transmitting-receiving device according to the present invention.

Hereinafter, a transmitting-receiving device employing the directional coupler or the antenna device in accordance with the present invention will be described. FIG. 7 is a circuit diagram of the transmitting-receiving device of the present invention.

As shown in FIG. 7, a transmitting-receiving device 61 of the present invention comprises an antenna 51, a circulator 62 connected to the antenna device 51, an oscillator 63 connected to one of the ports of the circulator 62, a mixer 64 connected to the other port of the circulator 62, a second circulator 65 connected between the circulator 62 and the oscillator 63, and couplers 66 and 67. In this case, the oscillator 63 is a voltage-controlled oscillator. The oscillation frequency is changed by applying a voltage to its bias terminal. The antenna device 51 shown in FIG. 7 is the antenna device of the sixth embodiment. A lens antenna (not shown in FIG. 7) is arranged in the radiation direction of an electromagnetic wave from the primary antenna device. In the transmitting-receiving device 61 having the above configuration, a signal from the oscillator 63 is propagated through the circulator 65, the coupler 66, and the circulator 62 to the primary radiator of the antenna device 51, and radiated through the lens antenna. A part of the signal from the oscillator 63 as a local signal is supplied through the couplers 66 and 67 to the mixer 64. The reflected wave from an object is supplied through the antenna device 51, the circulator 62, and the coupler 67 to the mixer 64 as an RF signal. The mixer 64 as a balanced mixer outputs as an IF signal a differential component between the RF signal and the local signal.

The transmitting-receiving device of FIG. 7 employs the antenna device 51 described in the sixth embodiment. However, this is not restrictive, and any one of the directional couplers of the above-described first through third embodiments and the antenna devices of the fourth and fifth embodiments may be applied as the transmitting-receiving device of FIG. 7.

In the directional coupler in accordance with the present invention, the coupling portion can be shifted in parallel, and the first transmission line and the second transmission line are shifted in parallel from their opposite state to their non-opposite state, and thereby, the coupling portion of the directional coupler can be used as a switch.

Preferably, either of the first transmission line and the second transmission line consists of plural transmission lines, and thereby, the switching on-off of the plural transmission lines is enabled, and switching of the plural transmission lines can be performed.

The directional coupler in accordance with the present invention has the structure that the first transmission line consists of one transmission line, and is shifted in parallel while the coupling state for the second transmission line is maintained, so that the first transmission line is connected to the plural third transmission lines, sequentially. In this directional coupler, the moving range is narrow as compared with the above directional coupler in which either of the first transmission line or the second transmission line comprises plural transmission lines. That is, the whole device can be miniaturized.

Preferably, in the antenna device in accordance with the present invention, the transmittance-reception through the antenna can be switched.

Also preferably, in the antenna device in accordance with the present invention, the first transmission line comprises plural transmission lines, the primary radiators are coupled with the respective first transmission lines at their different arrangement positions, and shifted in parallel, and thereby, multi-beam scan with plural beams is enabled. As compared with a general multi-beam antenna device, the number of the primary radiators can be reduced, and the whole antenna device can be miniaturized. In addition, the connection, switching, and arrangement of the respective antennas can be easily performed.

In the antenna device in accordance with the present invention, preferably, one of the plural first transmission lines is used for measurement. Accordingly, the characteristics of the antenna device which is in the coupling state caused by the directional coupler can be measured.

Preferably, in the antenna device in accordance with the present invention, the terminal resistor is removable, and one end of the second transmission line having the terminal resistor connected thereto is for measurement. Accordingly, the characteristics of the antenna device in the step before coupling by means of the directional coupler can be measured.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A directional coupler including a first transmission line and a second transmission line which are partially opposite to each other, opposite portions of the first transmission line and the second transmission line being relatively shiftable in parallel, said first transmission line capable of being connected, by a parallel shift of the first transmission line, to plural third transmission lines individually which are on a side thereof opposite to the opposite portions of the first transmission line and the second transmission line.

2. An antenna device comprising a directional coupler including a first transmission line and a second transmission line which are partially opposite to each other, opposite portions of the first transmission line and the second transmission line being relatively shiftable in parallel, said first transmission line capable of being connected, by a parallel shift of the first transmission line, to plural third transmission lines individually which are on a side thereof opposite to the opposite portions of the first transmission line and the second transmission line and further comprising a primary radiator connected to the first transmission line and a terminal resistor connected to one end of the second transmission line.

3. A transmitting-receiving device comprising an antenna device comprising a directional coupler including a first transmission line and a second transmission line which are partially opposite to each other, opposite portions of the first transmission line and the second transmission line being relatively shiftable in parallel, said first transmission line capable of being connected, by a parallel shift of the first transmission line, to plural third transmission lines individually which are on a side thereof opposite to the opposite portions of the first transmission line and the second transmission line and further comprising a primary radiator connected to the first transmission line and a terminal resistor connected to one end of the second transmission line.

* * * * *